United States Patent [19]

Mathe et al.

[11] 3,966,293

[45] June 29, 1976

[54] HOOD ASSEMBLY FOR AN ELECTRICAL CONNECTOR

[75] Inventors: Istvan Mathe, Cicero; Ronald Richard Maros, Elmhurst, both of Ill.

[73] Assignee: Bunker Ramo Corporation, Oak Brook, Ill.

[22] Filed: Dec. 30, 1974

[21] Appl. No.: 537,087

[52] U.S. Cl. ..... 339/103 R; 339/75 M

[51] Int. Cl.[2] ..... H01R 13/58

[58] Field of Search ..... 339/103, 107, 75 M, 339/99 R, 97 R, 97 P

[56] References Cited

UNITED STATES PATENTS 3,489,986 1/1970 Frederick ..... 339/75 M X

*Primary Examiner*—Roy Lake
*Assistant Examiner*—DeWalden W. Jones
*Attorney, Agent, or Firm*—William Lohff; F. M. Arbuckle

[57] ABSTRACT

A hood assembly for an electrical connector includes a pair of complementary releasably engageable hollow housing shells. Each of the shells is a unitary molded one-piece structure which includes slots for receiving flanges of an electrical connector for mounting the connector in the hood assembly. Each of the shells also includes a longitudinally extending inwardly projecting rail or rib immediately adjacent the strain relief mechanism of the connector, or a strain relief adapter mounted on the connector, to press against the individual conductors and provide additional strain relief. The shells are provided with complementary recesses which are cooperable to form openings for passing bundles of conductors or individual conductors therethrough, the edges of the openings also functioning to clamp the conductors when the shells are connected together. The recesses may be provided at different locations on the housing assembly for various conductor distribution arrangements including an L-shaped arrangement and a T-shaped arrangement.

14 Claims, 13 Drawing Figures

Fig. 7
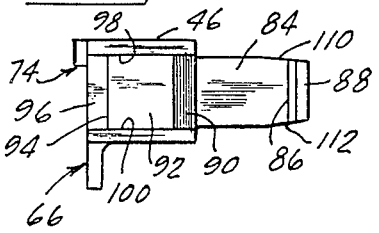
Fig. 6
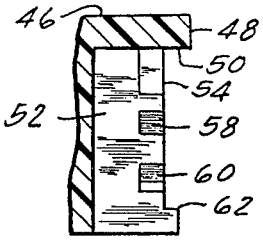
Fig. 8
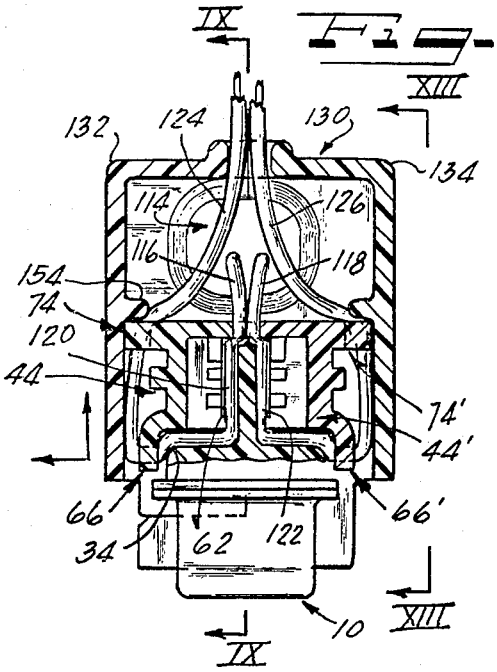
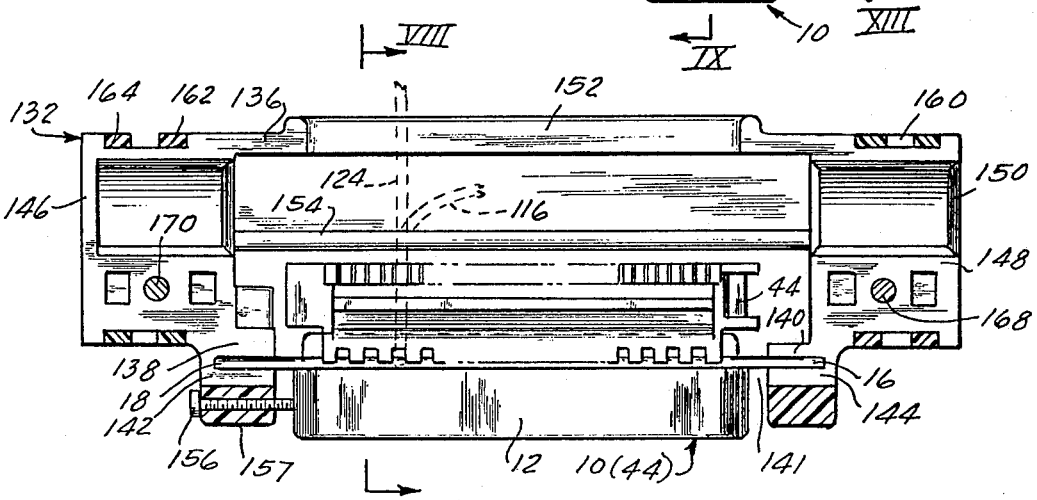
Fig. 9
Fig. 10
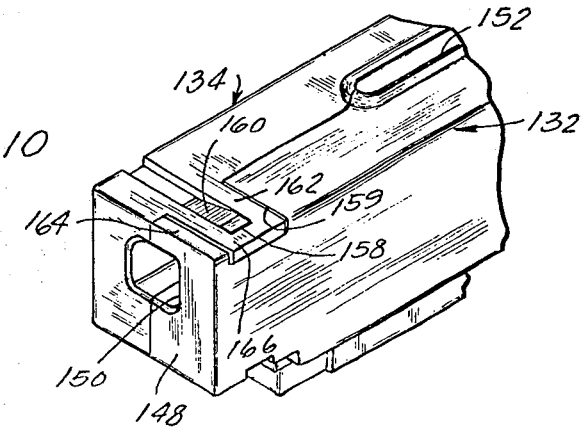

HOOD ASSEMBLY FOR AN ELECTRICAL CONNECTOR

CROSS REFERENCE TO RELATED APPLICATION

The subject matter of this application is related to the subject matter disclosed by ISTVAN MATHE in his United States patent application entitled "Strain Relief Adapter for an Electrical Connector," Ser. No. 537,192, filed on even date herewith.

BACKGROUND OF THE INVENTION

1. Field of the Invention

This invention relates to a hood assembly for an electrical connector, and more particularly to a hood assembly which provides strain relief for conductors which are electrically connected to contact portions of contacts supported by an electrical connector.

2. Description of the Prior Art

Hood assemblies for electrical connectors are well known in the art. The primary purpose for a hood assembly is to protect the electrical connections of the conductors from damage with respect to mechanical forces and foreign substances. Heretofore, hood assemblies were primarily structures which could be slid over an electrical connector and clamped about an incoming cable. Usually, the hood assemblies are molded structures of metallic material and provide a rigid protective cover for an electrical connector. Ordinarily, the hood assemblies are for dead end arrangements and not for tapped connections wherein the conductors are extended beyond the electrical connector for connection to other components, such as relays or the like.

In view of this, it is highly desirable to have a hood assembly which, in addition to providing protection for an electrical connector, may be utilized to clamp and properly distribute both incoming and outgoing electrical conductors, a structure which is highly advantageous to permit direct wire wrapping to relays and other similar devices as extensively utilized in telephone central office equipment.

SUMMARY OF THE INVENTION

It is therefore the primary object of the invention to provide a new and improved hood assembly for an electrical connector which will properly distribute and clamp both the incoming and outgoing electrical conductors of a tapped conductor arrangement.

Another object of the invention is to provide a hood assembly which is easy to install over an electrical connector and in which the hood assembly does not require additional parts for clamping the incoming and outgoing conductors.

Another object of the invention is to provide a hood assembly for an electrical connector of two parts in which the parts are complementary to each other for conductor clamping and releasable engagement of the parts.

Another object of the invention is to provide a hood assembly for an electrical connector which may be readily constructed for either L-shaped or T-shaped conductor tapped arrangements.

Another object of the invention is to provide a hood assembly for an electrical connector which avoids the necessity of additional parts for mounting the electrical connector in the hood assembly.

Still another object of the invention is to provide a hood assembly for an electrical connector which augments and provides additional strain relief for the electrical and mechanical contact of the individual conductors and their respective contact portions which are supported by the electrical connector.

According to the invention, a hood assembly for an electrical connector, of the type set forth above, comprises a hollow housing which includes a pair of complementary housing shells which are releasably interengageable to form a hollow housing for receiving an electrical connector. Each of the housing shells comprises a top wall, a sidewall and a pair of end walls and a pair of spaced bottom portions which, upon mating of the housing shells, form an opening through which the front portion of the connector extends for access to a mating connector. A pair of walls is spaced from respective ones of the bottom portions to form slots for receiving mounting flanges of the connector. A rib or rail extends longitudinally of and projects into the housing from each sidewall to engage the conductors adjacent the strain relief mechanism of the connector to provide additional strain relief. Complementary recesses in the housing shells cooperate to form openings, upon interengagement of the shells, for receiving conductors therethrough and properly clamping and distributing the conductors.

More specifically, a hood assembly constructed in accordance with the invention comprises a pair of hollow housing shells, as generally defined above, which are one-piece molded structures which carry complementary releasable engagement structures, in the form of complementary ramp-shoulder and resilient shoulder-engaging arm structures for joining the two shells and clamping the conductors.

Additional fastening means for the shells may be provided, if desired, in the form of screws or the like.

The conductor receiving openings in the housing may take several positions and shapes. For example, if an electrical connector is to be connected to a plurality of conductors so as to provide an L-shaped tap arrangement of the conductors wherein the conductors are received in a bundle and exit as individual conductors, an end opening is provided to receive the bundle of conductors through an end wall and a narrow slot is provided to distribute the conductors in a generally planar arrangements through an adjacent wall, for example, the top wall. If the tap arrangements is to extend the conductors on as a group or bundle, similar openings may be provided in each of the end walls. In this case, the housing shells are not only complementary, they may be identical.

Each of the housing shells may also include a boss below at least one of the bottom portions for receiving an adjustment screw to provide accurate longitudinal alignment of the connector with respect to the hood assembly. Such bosses may advantageously extend from one bottom portion of a housing shell so as to lie immediately below the complementary bottom portion of the other housing shell and provide additional rigidity for the hood assembly.

BRIEF DESCRIPTION OF THE DRAWINGS

Other objects, features and advantages of the invention, its organization, construction and operation will be best understood from the following detailed description of a preferred embodiment of the invention taken in conjunction with the accompanying drawings, in which:

FIG. 6 is a partial fragmentary sectional view taken substantially along the parting line VI—VI of FIG. 5;

FIG. 7 is an end view taken in the direction VII—VII of FIGS. 3 and 4;

FIG. 8 is a sectional view, taken substantially along the line VIII—VIII of FIG. 9 illustrating a pair of the adapters of FIG. 4 mounted on an electrical connector and covered with a hood assembly which provides additional strain relief;

FIG. 9, is a complementary sectional view taken substantially along the parting line IX—IX of FIG. 8 illustrating an adapted connector mounted in one shell of the hood assembly, specifically showing the hood assembly features for providing an incoming bundle clamp and outgoing conductor distribution;

FIG. 10 is a perspective view of the hood assembly of FIGS. 8 and 9 specifically illustrating a latching structure for releasably locking the housing shells together;

DESCRIPTION OF THE PREFERRED EMBODIMENTS

Figure 1:
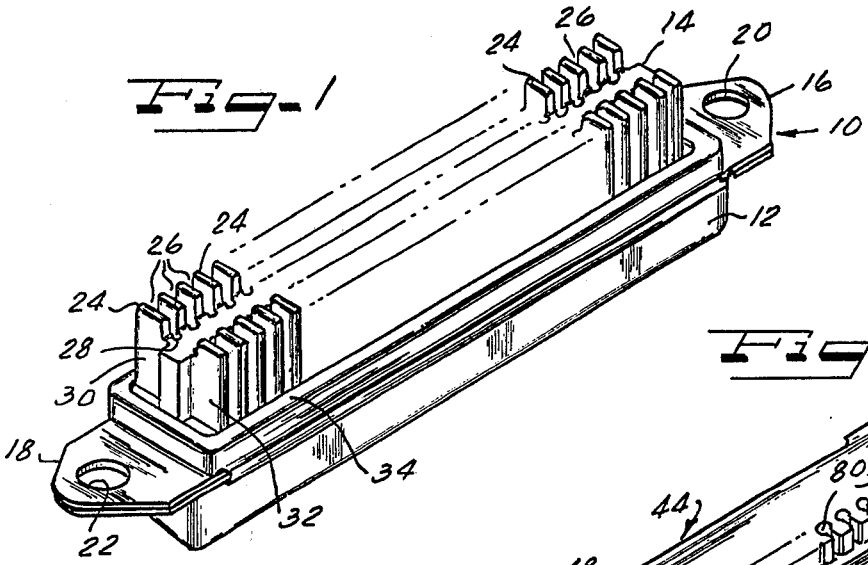
FIG. 1 is a perspective view of an elongate electrical connector which may advantageously be provided with strain relief according to the invention.
Figure 4:
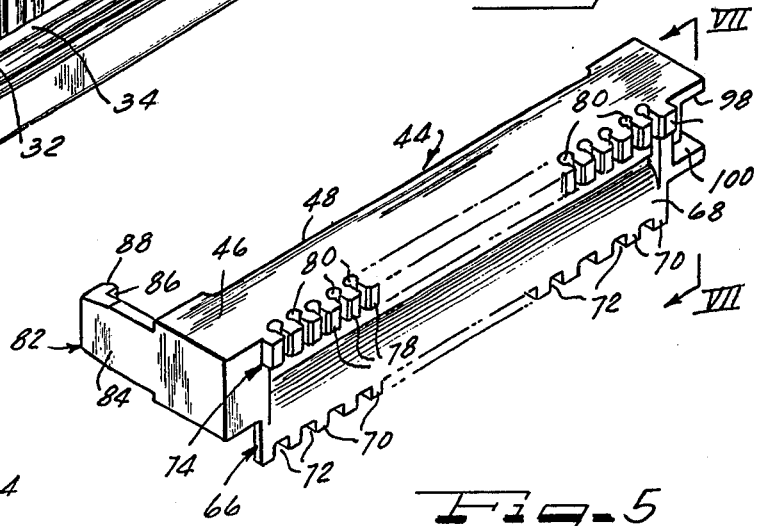
FIG. 4 is a perspective view of a strain relief adapter according to the invention, specifically illustrating the outer side and one end of the strain relief adapter.

Referring to FIG. 1, an electrical connector is generally illustrated at 10 as comprising a forward portion 12 which, as is well known in the art, is matable with a complementary connector unit, and a rear portion 14 which carries the contact portions for connection to individual conductors of a bundle or cable. Connectors of this type may advantageously be provided with insulation-piercing contact portions, one type of which will be discussed below.

The connector 10 also comprises means for mounting the connector to a supporting device or surface, depending on its particular application, and in the particular connector illustrated in FIG. 1 a pair of flanges 16 and 18, including respective mounting holes 20 and 22 are illustrated as one type of such mounting means.

The rear portion 14 of the connector 10 is usually molded from a plastic material as a structure which includes a plurality of spaced vertical ribs 24 defining a plurality of channels 26 therebetween on each side of the connector. The inner portion of each channel 26 includes a constricted opening 28 for receiving a conductor and providing a certain amount of a strain relief.

The rear portion 14 of the connector 10 includes a pair of recesses 30 and 32 at each end thereof which, as will be understood from the description below, aids in locating and aligning the strain relief adapter.

It should be mentioned here that although reference may be made to specific directions and relationships, such as vertical, horizontal, above and below, these directions and relationships are utilized for clarity only with respect to the particular orientation of the apparatus as illustrated on the drawings. It will be appreciated that these terms are only limiting in their senses of relationship with respect to each other in that an electrical connector may be oriented in an almost limitless number of positions, as is well known to those versed in this art.

Figure 2:
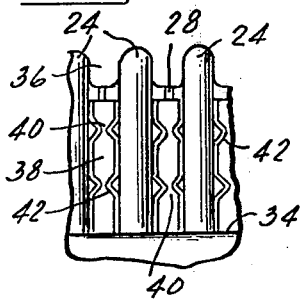
FIG. 2 is a fragmentary enlarged view of a part of the rear portion of the electrical connector of FIG. 1 specifically showing a suitable structure for an insulation-piercing contact portion.
Figure 5:
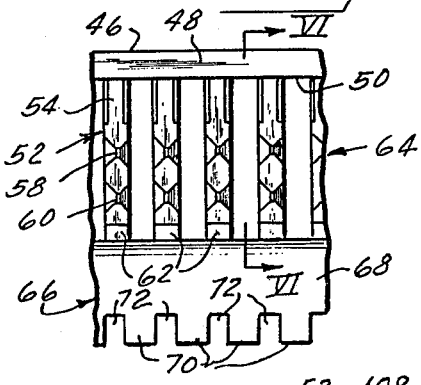
FIG. 5 is an enlarged fragmentary view of a portion of the elevation of FIG. 3 to more specifically show the structure of the pressure members and the relationship between the pressure members and the structure provided for force diversion.

Referring to FIG. 2, a view of part of the rear portion of the connector 10 of FIG. 1 is illustrated in an enlarged view to more clearly show that the ribs 24 define channels which have insulation-piercing contact portion 38 supported therein, each of the contact portions 38 including one or more insulation-piercing notches 40 formed by a pair of opposed sharp edge portions 42. The channels 26 extend upwardly to form notches 36 to receive and have the conductors dressed therein prior to actual electrical connection to the insulation-piercing contact portions 38. Although this specific structure is illustrated herein, it is only typical of many suitable contact structures which may be utilized in an electrical connector and which may be supplemented, with respect to strain relief, by a strain relief adapter constructed in accordance with the invention.

Referring to FIGS. 3–7, a strain relief adapter constructed according to the invention is illustrated at 44 as comprising a generally rectangular, elongate element, preferably molded of plastic material, and which comprises an upper surface 46 having a shallow edge recess 48 which presses against the incoming portions of the conductors above the constricted notches 28 to increase the strain relief at the incoming portions of the conductors.

The recess 48, as can be seen in FIG. 6, is carried on a ledge member 50 which, when mounted on the connector, rests on the upper ends of the vertical ribs 24.

A plurality of pressure members, in the form of blades 52 which are similar to conductor insertion blades, are to be received in the channels to engage and press against the conductors which have already been electrically contacted by the contact portions. Each of the blades 52 comprises a first narrow portion 54 to engage the respective conductor adjacent its entry into the connector strain relief mechanism, second and third narrow portions 58 and 60 for engaging the conductor adjacent the insulation-piercing notches 40, and a spur or projection 62 which extends beyond the distal edge of the blade proper to slightly dig into the insulation of the conductor and provide additional securement within the contact portion 38. The plurality of insertion blades 52 have been given the collective reference numeral 64 and constitute a means for engaging and urging each of the conductors into the respective insulation-piercing contact portion. The vertical ribs 24 constitute barriers between the contact portions 38 which may be pushed apart by an insertion tool or by over size conductors causing decreased pressure on the conductors and the possibility of decreased electrical reliability. The insertion blades 52 therefore provide several advantages including additional pressure on the conductors, realignment of the barriers in those cases where the barriers have been deformed, and filling of the barriers to provide additional frictional forces between the barriers, the contact portions and the insulated conductors via the blades 52 for a tighter and more reliable assembly.

The strain adapter 44 is also provided with a force diversion means 66 (FIG. 4) which comprises a downwardly projecting member 68 having a lower edge formed in the shape of a comb having a plurality of teeth 70 and spaces 72 between the teeth 70. It will be apparent from FIG. 5 that each of the spaces 72 is aligned with a pressure blade 52, and as such receives a conductor therein, the conductor being subsequently bent upwardly so that the conductor at least partially wraps about the force diverter.

A wire clamping means 74 (FIG. 4) is provided opposite the recess 48 and the upper portions of the blades 52 and is constituted by a comb-shaped edge having a plurality of shaped teeth which form a plurality of complementary shaped constricted openings 80. Each of the openings 80 is aligned with a respective opening 72 of the force diverter to receive and hold the outgoing portion of the conductor in a position generally parallel to the electrically contacted portion of the conductor.

A pair of strain relief adapters is utilized for providing additional strain relief on each side of the rear portion of an electrical connector. Advantageously, each of the strain relief adapters is identical to the other and asymmetrically complementary when positioned on opposite sides of the rear portion of a connector to be cooperatively interengageable with respect to mounting on the connector. For this purpose, each of the strain relief adapters is provided with a releasable locking means 82 which, as can be best seen from FIGS. 4 and 7, comprises at one end of the adapter a resilient yieldable arm 84 which projects laterally from the adapter proper and which terminates in a second projection 86 extending perpendicular thereto to form a hook. The distal end of the projection 86 includes a cam surface 88 which functions in cooperation with another element to flex the arm 84 during engagement of the two adapters.

The releasable locking means 82 further comprises, at the other end of the adapter, a cam surface 90 which leads to a flat surface 92 which together form a barrier that terminates at a shoulder 94. Beyond the shoulder 94 is a recess 96, and the surface 92 also constitutes the rear surface of another recess formed by a pair of surfaces 98 and 100.

As the two adapters are moved into engagement about opposite sides of the rear portion 14 of a connector, the cam surface 88 slidably engages the cam surface 90 flexing the arm 84 until the projection 86 slides along the surface 92. The projection 86 continues to slide along the surface 92 until it passes the shoulder 94 whereupon the energy stored in the flexed arm 84 is released causing the projection 86 to snap into the recess 96 and the arm 84 to snap into the recess formed between the surfaces 92, 98 and 100.

Figure 3:
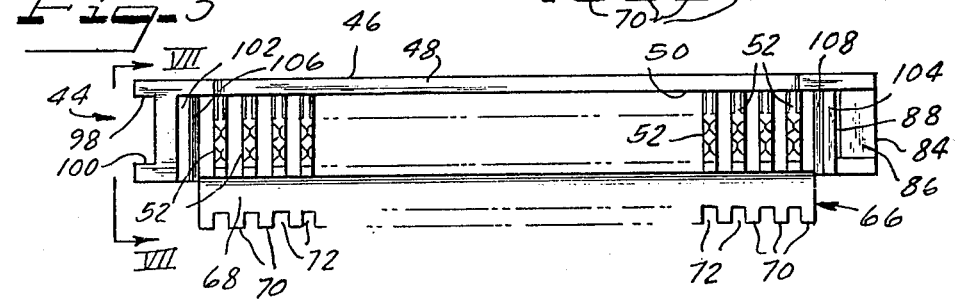
FIG. 3 is an elevation of the inner side of a strain relief adapter constructed in accordance with the present invention.

The adapter 44 is also provided with means for positioning, aligning, and guiding the adapter with respect to the connector and with respect to the other cooperative adapter. Referring to FIGS. 1 and 3, each adapter 44 is provided with a pair of shoulders 102 and 104 and respective cam guide 106 and 108 to be received in the recesses 30 and 32. In addition, and as can best be seen in FIG. 7, the resilient yieldable arm 84 has upper and lower papered guide edges 110 and 112, respectively, for initially guiding the arm into the area between the surfaces 98 and 100.

Referring to FIG. 8, a pair of adapters 44 and 44' are illustrated in section as they appear when mounted on a connector 10. In FIG. 8 a bundle of conductors, which may be in the form of a cable 114, has a plurality of conductors which are electrically connected to respective insulation-piercing contacts of an electrical connector. For simplicity, only two of such conductors have been illustrated. These two conductors include an incoming or lead in portion 116 and 118, respectively, an electrically contacted or intermediate portion 120 and 122, respectively, and a lead out or outgoing portion 124 and 126, respectively. In FIG. 8 the digging in of the projection or spur 62 is apparent, as is the additional strain relief provided by the shallow recess 48 and the wire clamping means 74. Also in FIG. 8 it will be appreciated that the force diverter 66 functions to prevent dislocation of conductors from the piercing notches of the contact portions when a pulling force is applied in the direction of the arrows.

The strain relief adapted connector is provided with additional strain relief and is protected by a hood assembly in the form of a hollow housing 130 having a pair of complementary hollow shells 132 and 134, which are more specifically described below with reference to FIGS. 9–13. In FIG. 9, an adapted connector illustrated as being mounted in the hollow housing shell 132. The housing shell 132 includes a top wall 136, a pair of spaced bottom portions 138 and 140, which define a recess through which the front portion 12 of the connector extends, a pair of portions 142 and 144 spaced from the bottom portions 138 and 140 to form slots for receiving the mounting flanges 18 and 16 of the connector 10, and a pair of end walls 146 and 148.

The end wall 148 is provided with a semi-circular recess 150 and the top wall 136 is provided with a shallow recess defined by a raised edge 152. The recesses 141, 150 and 152 are cooperative and complementary to form openings in the hollow hood assembly 130. As mentioned above, the front portion 12 of the connector 10 extends through the opening formed by by the recess 141 and its complementary recess. The recess 150 and its complementary recess form an opening for receiving a bundle of conductors which may be in the form of a cable, while the recess defined by the edge 152 and its complementary recess forms an elongate narrow slot for distributing the individual conductors.

Each of the housing shells is provided with a longitudinally extending rail 154 which projects into the hollow interior of the housing at a point immediately above and adjacent the wire clamping means 74 of the strain relief adapter 44. As can be seen more clearly in FIG. 8, the rail 154 engages and presses the conductors toward the rear of the strain relief slots 80 to provide additional strain relief to the outgoing portions of the conductors.

Each of the shells is also provided with a boss 157 (FIG. 9) which has an adjustment screw 156 threaded therethrough to engage and position the connector longitudinally with respect to the housing.

The housing shells 132 and 134 are provided with a releasable latching means which performs several functions. First of all, as the shells are latched together, they clamp incoming and outgoing conductors so that additional strain relief is provided for the entire hooded assembly. Secondly, the shells are releasably held together by the releasable latching means. Although four such structures have been indicated on the drawings, only one is illustrated in detail for discussion, the others being of the same structure. The housing shell 132, for example, includes a recess 159 (FIG. 10) in which there is a shoulder 158 which develops into a ramp 160 that terminates at the parting line of the shells. The complementary shell 134 includes a pair of resilient yieldable arms 162 and 164 having a cross member 166 at the distal ends thereof which rides up the ramp 160 until passing the shoulder 158 whereupon the arms 162 and 164, and the cross member 166 snap into the recess 159.

Figure 13:
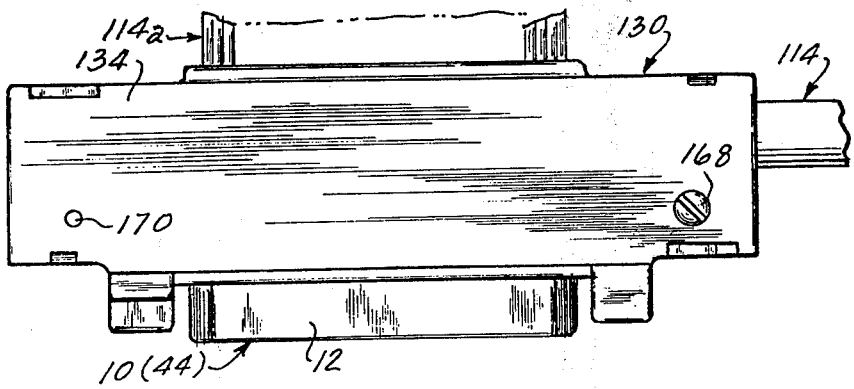
FIG. 13 is an elevational view of the apparatus of FIG. 8 as viewed in the direction XIII—XIII of FIG. 8.

A completely assembled hooded and strain relief adapted electrical connector 10 is illustrated in FIG. 13 as receiving a cable 114 and distributing a plurality of individual conductors 114a. The hollow shells of the hood assembly 130 may be additionally and more securely held together by the utilization of suitable additional fastening means, such as machine screws 168 and 170.

The hood assembly and conductor receipt and distribution illustrated in FIG. 13 provides for a L-shaped conductor distribution. Different forms of T-shaped conductor distribution are illustrated in FIGS. 11 and 12.

Figure 11:
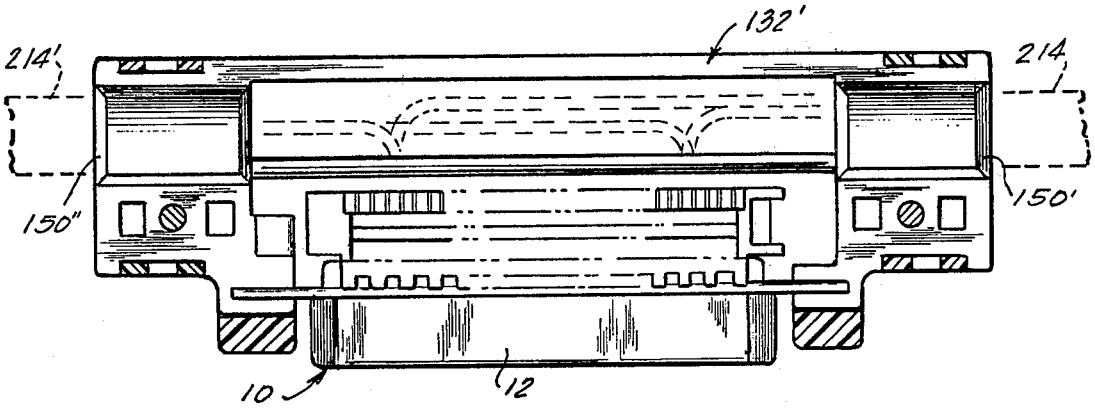
FIG. 11 is a elevation of a housing shell with an electrical connector mounted therein, specifically showing the shell adapted for receiving and clamping incoming and outgoing bundles of conductors.
Figure 12:
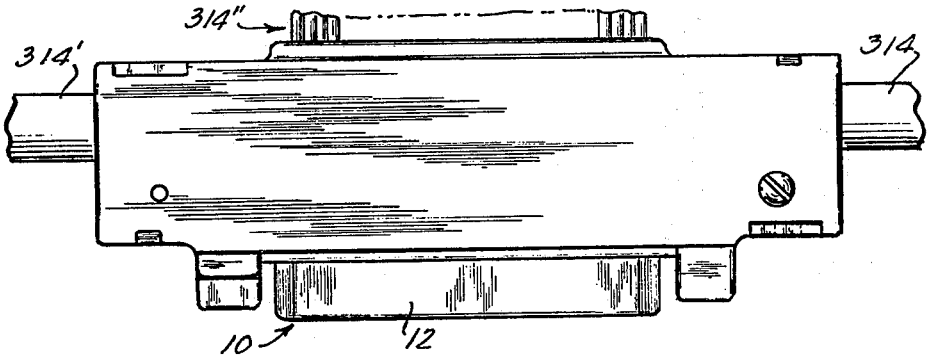
FIG. 12 is a completed housing assembly, with a connector mounted therein, similar to FIG. 11 additionally showing a narrow slot for distributing a portion of the conductors.

The hollow shells in FIGS. 11 and 12 have substantially the same structure as that previously discussed. Therefore, only distinguishing features will be dealt with in connection with the T-shaped conductor distribution arrangements.

In FIG. 11, for example, the housing 132' receives a plurality of incoming conductors in the form of a bundle or a cable 214 which are electrically tapped at the connector 12 and become outgoing conductors in the form of a bundle or cable 214'. The housing shell 132', and its complementary shell, are provided with end wall openings 150' and 150'' for passing the conductors therethrough and clamping the pluralities of conductors when the hood assembly is latched together.

A combination of distributions between the structures of FIGS. 9 and 11 is illustrated in FIG. 12 wherein the adapted connector 10 receives a plurality of conductors in the bundle or cable 314 at one end of the hood assembly, passes through a number of those connectors in the form of a bundle or cable 314' at the opposite end of the assembly, and distributes the remaining number of individual conductors, as indicated at 314''. This conductor arrangement also takes into consideration that some of the conductors may be tapped and extended in a first direction, other conductors tapped and extended in a second direction, and even that further conductors may be extended through the hood assembly for ease in wire distribution without being tapped or terminated. Also, dead end terminations may be accomplished with the conductor tap and strain relief features disclosed herein without extension of the outgoing leads much beyond the strain relief provided by the wire clamping means 74, and possibly the ridge 154.

Although the present invention has been described by reference to particular illustrative embodiments thereof, many changes and modifications of the invention may become apparent to those skilled in the art without departing from the spirit and scope of the invention. It is therefore intended that the patent warranted hereon include all such changes and modifications as may reasonably and properly be included within the scope of this contribution to the art.

We claim:

1. A hood assembly for an electrical connector which supports a plurality of contacts, which connector has a front portion and a rear portion, and which electrically taps at said contacts a plurality of conductors which are received in a bundle and exit the connector individually, said hood assembly comprising:

a hollow housing including means defining a first opening and means for mounting the connector in said housing with the front portion of said connector extending through the first opening;

means defining a second opening for receiving the bundle of conductors, including means for clamping the bundle of conductors in the second opening; and means defining a narrow slot for receiving the individual conductors therethrough and distributing the same in a generally side-by-side relationship.

2. A hood assembly for an electrical connector which supports a plurality of contacts, which connector has a front portion and a rear portion, and which electrically taps at said contacts individual conductors of a plurality of conductors which are received in an incoming bundle and exit the connector in an outgoing bundle, said hood assembly comprising:

a hollow housing including means defining a first opening and means for mounting the connector in said housing with the front portion of said connector extending through the first opening;

means defining a second opening for receiving the incoming bundle of conductors;

means defining a third opening for receiving the outgoing bundle of conductors therethrough; and means for clamping the incoming and outgoing bundles of conductors in the respective second and third openings.

3. A hood assembly for an electrical connector which has a front portion, a rear portion and mounting flanges, and which is provided with a strain relief mechanism which extends longitudinally of the connector to provide strain relief for individual conductors electrically connected to contacts of the electrical connector, said hood assembly comprising:

a pair of housing shells which together define a hollow housing for receiving the connector, each of said shells including first means defining a first recess which with the like first recess forms an access opening for the front end of the connector, second means defining a pair of slots to receive at least portions of respective mounting flanges, third means defining a second recess which with the like second recess forms an opening for the conductors to pass through on one side of their contact connections, fourth means defining a third recess which together with the like recess forms an opening for the conductors to pass through on the other side of their contact connections, and fifth means for releasably engaging the like fifth means to releasably couple said shells together.

4. A hood assembly according to claim 3, wherein at least one of said shells further comprises:

a longitudinally extending rail projecting into the hollow housing at a point adjacent the location of the strain relief mechanism to engage and urge the conductors toward the mechanism for additional strain relief.

5. A hood assembly for an electrical connector which has a front portion, a rear portion, and a mounting flange at each end, and which is provided with a strain relief mechanism which extends longitudinally along the rear portion to provide strain relief for individual conductors electrically connected to contacts of the electrical connector, said hood assembly comprising:

a pair of complementary housing shells which together form a hollow housing for receiving the connector, each of said housing shells comprising:

a top wall, a side wall and a pair of end walls, a pair of spaced bottom portions which with the like pair of bottom portions of the other shell form an opening through which the connector front portion extends, a pair of walls spaced from respective ones of said bottom portions to form slots for receiving portions of the connector mounting flanges, a rail extending longitudinally of and projecting into the housing from said side wall to engage the conductors adjacent the strain relief mechanism to provide additional strain relief, and means defining recesses in at least two of said walls which complement like recesses in the other housing shell to form openings for passage of the conductors.

6. A hood assembly according to claim 5, wherein the last-mentioned means defines recesses in said top wall and in one of said end walls.

7. A hood assembly according to claim 5, wherein the last-mentioned means defines recesses in each of said end walls.

8. A hood assembly according to claim 5, wherein the last-mentioned means defines recesses in said top wall and in each of said end walls.

9. A hood assembly according to claim 5, comprising fastening means for fastening said shells together.

10. A hood assembly according to claim 5, comprising: first and second complementary releasable engagement means to each of said shells cooperative with like means on the other shell to latch said shells together to form said hollow housing.

11. A hood assembly according to claim 10, wherein, on each of said shells, said first engagement means comprises at least one shoulder and a ramp leading to said shoulder, and said second engagement means comprises resilient yieldable arm means extending from the shell and shoulder engagement means carried at the distal end of said arm means to be cammed by said ramp of the other shell and snap behind said shoulder due to flexing of said arm means.

12. A hood assembly according to claim 10, wherein at least one of said shells includes adjustable means for engaging and locating the connector in the longitudinal direction.

13. A hood assembly according to claim 12, wherein said one shell includes a boss extending below at least one of said bottom portions, and screw means threaded through said boss to engage the front portion of the connector.

14. An assembly for an electrical connector which has a mounting member and a rear portion supporting a plurality of spaced-apart insulation piercing contact portions, and which electrically taps at said contact portions a plurality of insulated conductors which are received by said connector and exit therefrom individually, comprising:

a strain relief adapter including at least one pressure member to engage and press against a first portion of at least one of the insulated conductors, conductor receiving means outwardly spaced from said pressure member for receiving second portions of the insulated conductors along lines parallel to the first portions of the conductors, and force diversion means spaced from the pressure member and conductor receiving means for receiving the conductors and preventing dislocation of the first portions in response to the application of tensile forces to the conductors, and a hood member including a hollow housing including means for supporting the mounting member of the connector, opening means for passage of the conductors from within the hollow housing to the exterior thereof, and at least one side surface spaced adjacent the conductor receiving means of the adapter to provide a passage within the hollow housing for the exiting conductors.

* * * * *